US012773084B2

(12) United States Patent
Pfingsten et al.

(10) Patent No.: US 12,773,084 B2
(45) Date of Patent: Oct. 27, 2026

(54) TORQUE ASSISTED SURFACE MAINTENANCE MACHINE

(71) Applicant: Tennant Company, Eden Prairie, MN (US)

(72) Inventors: Mark Pfingsten, Minneapolis, MN (US); Andrew Verhasselt, Minneapolis, MN (US); Matthew Lotts, Minneapolis, MN (US)

(73) Assignee: TENNANT COMPANY, Eden Prairie, MN (US)

( * ) Notice: Subject to any disclaimer, the term of this patent is extended or adjusted under 35 U.S.C. 154(b) by 962 days.

(21) Appl. No.: 17/980,272

(22) Filed: Nov. 3, 2022

(65) Prior Publication Data

US 2023/0135665 A1 May 4, 2023

Related U.S. Application Data

(60) Provisional application No. 63/275,400, filed on Nov. 3, 2021.

(51) Int. Cl.
*A47L 11/40* (2006.01)
*A47L 11/14* (2006.01)

(52) U.S. Cl.
CPC ..... *A47L 11/4066* (2013.01); *A47L 11/14* (2013.01); *A47L 11/4011* (2013.01)

(58) Field of Classification Search
CPC .. A47L 11/4066; A47L 11/14; A47L 11/4011; A47L 11/4061; A47L 9/2852
See application file for complete search history.

(56) References Cited

U.S. PATENT DOCUMENTS

| | | | | |
|---|---|---|---|---|
| 5,044,043 | A | 9/1991 | Basham et al. | |
| 10,405,723 | B2 * | 9/2019 | Ickes | A47L 11/24 |
| 10,456,003 | B2 | 10/2019 | Dickrell et al. | |
| 10,765,286 | B2 | 9/2020 | Dickrell et al. | |
| 11,154,175 | B2 | 10/2021 | Carlson et al. | |

(Continued)

FOREIGN PATENT DOCUMENTS

EP 3047782 B1 8/2021

OTHER PUBLICATIONS

International Search Report and Written Opinion of the International Application No. PCT/US2022/048859, mailed Mar. 14, 2023, 16 pg.

*Primary Examiner* — Andrew A Horton
(74) *Attorney, Agent, or Firm* — Fredrikson & Byron, P.A.

(57) ABSTRACT

A surface maintenance machine includes a maintenance head assembly comprising one or more surface maintenance tools for performing a surface maintenance operation. The machine also includes wheels and an operator grab handle permitting the operator to apply a force to urge the machine to change orientation. The machine also includes a first and second motor controlled by a motor controller. The motor controller is configured to sense a parameter indicative of motor load on the first and second motor and control the power delivered to the first and second motor to maintain a torque output setting. Maintaining the torque output setting is in light of motor load on the first and second motor and the force applied to the machine by the operator. The control of power delivered to the motors to maintain the torque assists the force applied by the operator to the machine.

16 Claims, 5 Drawing Sheets

(56) References Cited

U.S. PATENT DOCUMENTS

| | | | | |
|---|---|---|---|---|
| 2017/0156560 | A1* | 6/2017 | Jung | G05D 1/648 |
| 2017/0235312 | A1 | 8/2017 | Yoshino | |
| 2019/0179307 | A1* | 6/2019 | Anderson | B60L 15/2036 |

* cited by examiner

TORQUE ASSISTED SURFACE MAINTENANCE MACHINE

CROSS-REFERENCE TO RELATED APPLICATION

This application claims the benefit of U.S. Provisional Application No. 63/275,400, filed Nov. 3, 2021, the content of which is hereby incorporated by reference in its entirety.

TECHNICAL FIELD

This disclosure relates generally to surface maintenance machines. Embodiments are disclosed herein relating to surface maintenance machines with a torque assisted power operation. More particularly, certain such embodiments disclosed herein include surface maintenance machines having a manually driven mode and an autonomously driven mode with the torque assisted power operation enabled in the manually driven mode.

BACKGROUND

Surface maintenance machines can be used to perform one or more surface maintenance tasks such as brushing, cleaning, polishing, and stripping surfaces. To perform one or more surface maintenance tasks, surface maintenance machines can be self-powered or manually powered (e.g., pushed) along a surface.

However, a variety of surfaces on which one or more surface maintenance tasks are performed can require additional, incremental force to move the surface maintenance machine as desired along such surfaces. This need for incremental force can be particularly burdensome when the surface maintenance machine is manually powered. Examples include pushing a surface maintenance machine up an inclined surface, holding a surface maintenance machine back to reduce speed down a declined surface, pushing a surface maintenance machine along a relatively high friction, or uneven (e.g., bumpy) surface, and turning a surface maintenance machine to aim the machine in a particular direction. Performing one or more surface maintenance tasks with such incremental force such can be inefficient and, when the surface maintenance machine is manually powered, require significant exertion on the part of the user. This can become burdensome on the user over an extended period of time.

SUMMARY

In general, this disclosure is directed to embodiments of a surface maintenance machine that is configured to execute a torque assisted power operation at the surface maintenance machine. The torque assisted power operation executed at the surface maintenance machine can be configured to apply a motive force at one or more wheels of the surface maintenance machine and, thereby, provide at least a portion of the motive force needed to move the surface maintenance machine along a surface during performance of a surface maintenance task. As such, the torque assisted power operation can provide a more efficient and user-friendly operation that can reduce the force the user needs to exert to power the surface maintenance machine along a surface. Moreover, in certain embodiments, the surface maintenance machine can be configured to execute the torque assisted power operation without necessitating that the user learn new or complicated surface maintenance machine maneuvering techniques.

One exemplary embodiment includes a surface maintenance machine. The surface maintenance machine includes a maintenance head assembly supported by the machine and extending toward a surface with the maintenance head assembly comprising one or more surface maintenance tools for performing a surface maintenance operation. The machine also includes first and second wheels for supporting the body over a surface for movement in a direction of travel with the first and second wheels disposed on opposite sides of a longitudinal centerline of the machine. Each of the first and second wheel have a rotational axis with angles formed between the rotational axes and a longitudinal centerline of the machine being fixed such that the first and second wheels rotate about fixed rotational axes. The machine further includes an operator grab handle positioned to the rear of a transverse centerline of the machine with the operator grab handle permitting the operator to apply a force on the grab handle urging the machine to change orientation towards a different direction of travel. The machine additionally includes a first motor coupled to the first wheel to drive the first wheel, a second motor coupled to the second wheel to drive the second wheel, and one or more motor controllers operatively connected to the first motor and the second motor. The one or more controllers are configured to operate in a torque assist mode whereby the one or more controllers sense a parameter indicative of an amount of motor load on the first motor and an amount of motor load on the second motor. The one or more controllers further control the power delivered to the first motor and the power delivered to the second motor to maintain a torque output setting in light of the motor load on the first motor and on the second motor and in light of the force applied on the grab handle urging the machine to change orientation. The control of the power delivered to the first motor and the second motor to maintain the setting of torque output assists the force applied on the grab handle to change orientation.

Another exemplary embodiment includes a method of providing a torque assist mode to a surface maintenance machine. The surface maintenance machine includes a maintenance head assembly supported by the machine and extending toward a surface with the maintenance head assembly comprising one or more surface maintenance tools for performing a surface maintenance operation. The method includes receiving a force on a grab handle of the machine urging the machine to change orientation towards a different direction of travel and sensing a parameter indicative of an amount of motor load on a first motor and an amount of motor load on a second motor. The first motor is coupled to a first wheel to drive the first wheel and the second motor is coupled to the second wheel to drive the second wheel with the first and second wheels supporting the body over a surface for moving in a direction of travel. The first and second wheels are disposed on opposite sides of a longitudinal centerline of the machine, and each has a rotational axis with angles formed between the rotational axes and a longitudinal centerline of the machine being fixed such that the first and second wheels rotate about fixed rotational axes. The method also includes controlling the power delivered to the first motor and the power delivered to the second motor to maintain a torque output setting in light of the motor load on the first motor and on the second motor, and in light of the force applied on the grab handle urging the machine to change orientation. Further, the control of the power delivered to the first motor and the second motor to maintain the setting of torque output assists the force applied on the grab handle to change orientation.

Another exemplary embodiment includes a surface maintenance machine that includes a maintenance head assembly supported by the machine and extending toward a surface with the maintenance head assembly comprising one or more surface maintenance tools for performing a surface maintenance operation. The machine also includes first and second wheels for supporting the body over a surface for movement in a direction of travel with the first and second wheels disposed on opposite sides of a longitudinal centerline of the machine. Each of the first and second wheel have a rotational axis with angles formed between the rotational axes and a longitudinal centerline of the machine being fixed such that the first and second wheels rotate about fixed rotational axes. The machine further includes a transaxle connecting the first and second wheels and an operator grab handle positioned to the rear of a transverse centerline of the machine. The operator grab handle permits the operator to apply a force on the grab handle to urge the machine to change orientation towards a different direction of travel. The machine additionally includes a motor coupled to the transaxle to drive the transaxle which drives the first wheel and the second wheel and one or more motor controllers operatively connected to the motor with the one or more controllers configured to operate in a torque assist mode. When in torque assist mode, the one or more controllers are configured to sense a parameter indicative of an amount of motor load on the motor and control the power delivered to the motor to maintain a torque output setting in light of the motor load on the motor and in light of the force applied on the grab handle urging the machine to change orientation. The control of the power delivered to the motor to maintain the setting of torque output assists the force applied on the grab handle to change orientation.

The details of one or more examples are set forth in the accompanying drawings and the description below. Other features, objects, and advantages will be apparent from the description and drawings, and from the claims.

BRIEF DESCRIPTION OF DRAWINGS

The following drawings are illustrative of particular embodiments of the present invention and, therefore, do not limit the scope of the invention. The drawings are intended for use in conjunction with the explanations in the following description. Embodiments of the invention will hereinafter be described in conjunction with the appended drawings, wherein like numerals denote like elements. The features illustrated in the drawings are not necessarily to scale, though embodiments within the scope of the present invention can include one or more of the illustrated features at the scale shown.

DETAILED DESCRIPTION

Exemplary embodiments of the present disclosure can be included, and executed, at a surface maintenance machine 200. Such surface maintenance machine 200 can be interchangeably operated between a manually driven mode and an autonomously driven mode. Such machines can be used to perform one or more surface maintenance operations (e.g., brushing, cleaning, polishing, stripping, etc.) at indoor (buildings, garages, hallways, etc.) and/or outdoor locations (e.g., roads, pavements, sidewalks, boulevards, etc.). In the manually driven mode, the surface maintenance machine 200, as illustrated in the exemplary embodiment shown, can be a walk-behind machine. Though in other embodiments within the scope of the present disclosure, when in the manually drive mode, the features described herein can be applied to a ride-on surface maintenance machine.

Figure 1:
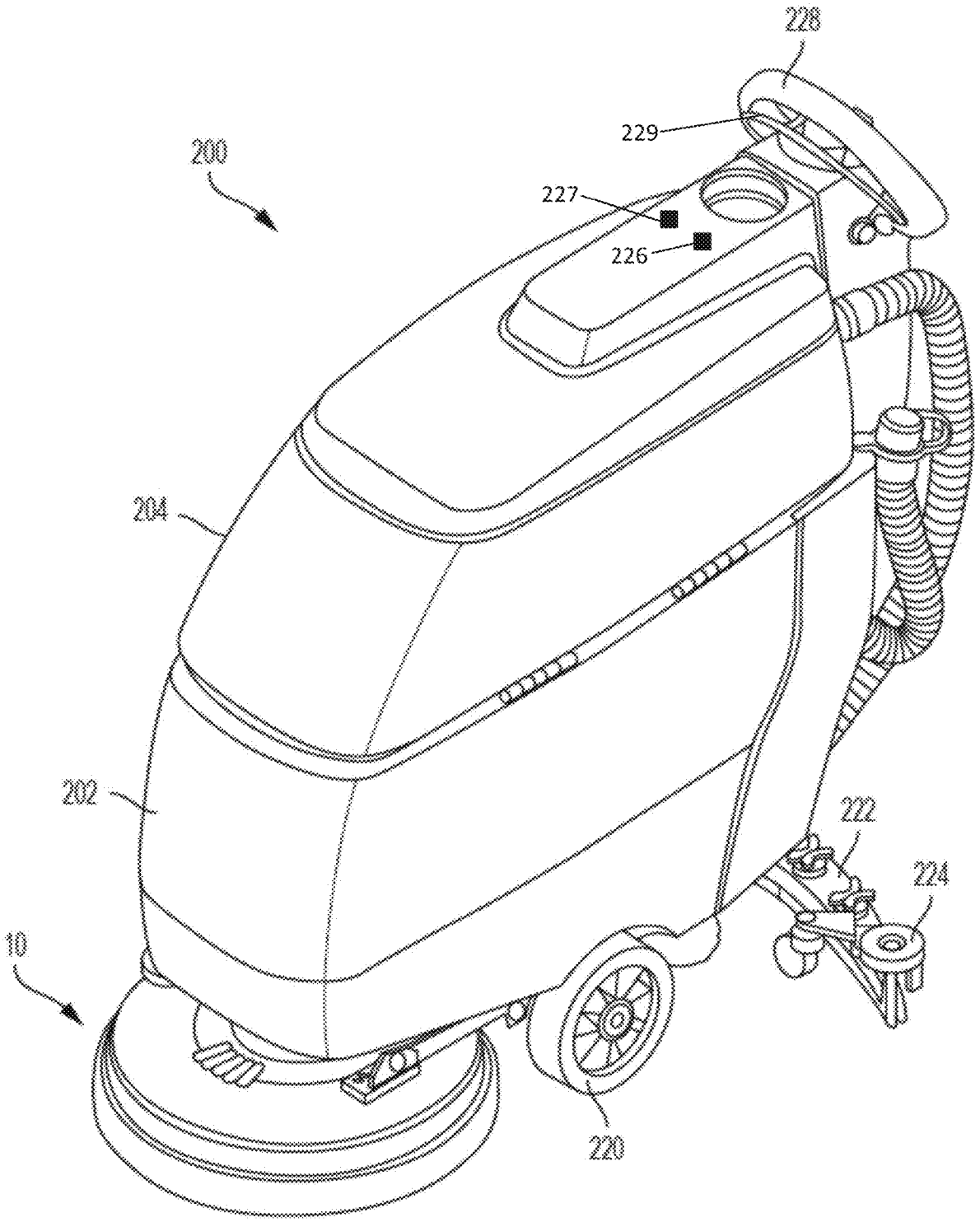
FIG. 1 is a perspective view of an exemplary embodiment a surface maintenance machine.

FIG. 1 is a perspective view of an exemplary surface maintenance machine 200. In the illustrated embodiment, the machine 200 is a walk-behind surface maintenance machine (e.g., for performing one or more surface maintenance tasks at a hard floor surface). In other embodiments, the machine can instead be a ride-on machine. Embodiments of the machine 200 include components that are supported on a motorized mobile body. The mobile body comprises a frame supported on wheels 220 for travel over a surface, on which a floor treating operation is to be performed. The mobile body includes a grab handle 228, a bail 229, and operator controls, including a manual/autonomous mode user input mechanism 226 and a torque assist user input mechanism 227. The machine 200 can be powered by an on-board power source, such as one or more batteries.

The machine 200 generally includes a base 202, that includes a frame, and a lid 204, which is attached along a side of the base 202 by hinges so that the lid 204 can be pivoted up to provide access to the interior of the base 202. The interior of the base 202 can also include a battery source and other electrical components of the machine 200. The base interior can also include a fluid source tank and a fluid recovery tank. The fluid source tank contains a fluid source such as a cleaner or sanitizing fluid that can be applied to the floor surface during treating operations. The fluid recovery tank holds recovered fluid source that has been applied to the floor surface and soiled.

The base 202 also includes a fluid recovery device 222, which includes a vacuum squeegee 224. The squeegee 224 is in vacuum communication with a fluid recovery tank. In operation, the squeegee 224 recovers soiled fluid from the floor surface and helps transport it to the recovery tank. The base 202 carries a cleaning head assembly 10. The cleaning head assembly 10 can be attached to the base 202 such that the cleaning head 10 can be lowered to a cleaning position and raised to a traveling position. The cleaning head assembly 10 is interfaced with an existing machine using any known mechanism, such as a suspension and lift mechanism. The cleaning head assembly 10 includes one or more rotatable brushes, such as disc-shaped or cylindrical scrub brushes. Alternatively, the cleaning head assembly 10 can include other cleaning tools such as a sweeping brush, or polishing, burnishing or buffing pads. The brushes or pads are held by a driver (e.g., a brush driver or a pad driver respectively) that, together with the brush or pad, is detachable from a hub of the cleaning head assembly 10. In certain embodiments, the cleaning head assembly 10 includes a magnetic coupling system that allows for touch-free attachment and aligning between the pad driver or brush driver and the hub.

Figure 2:
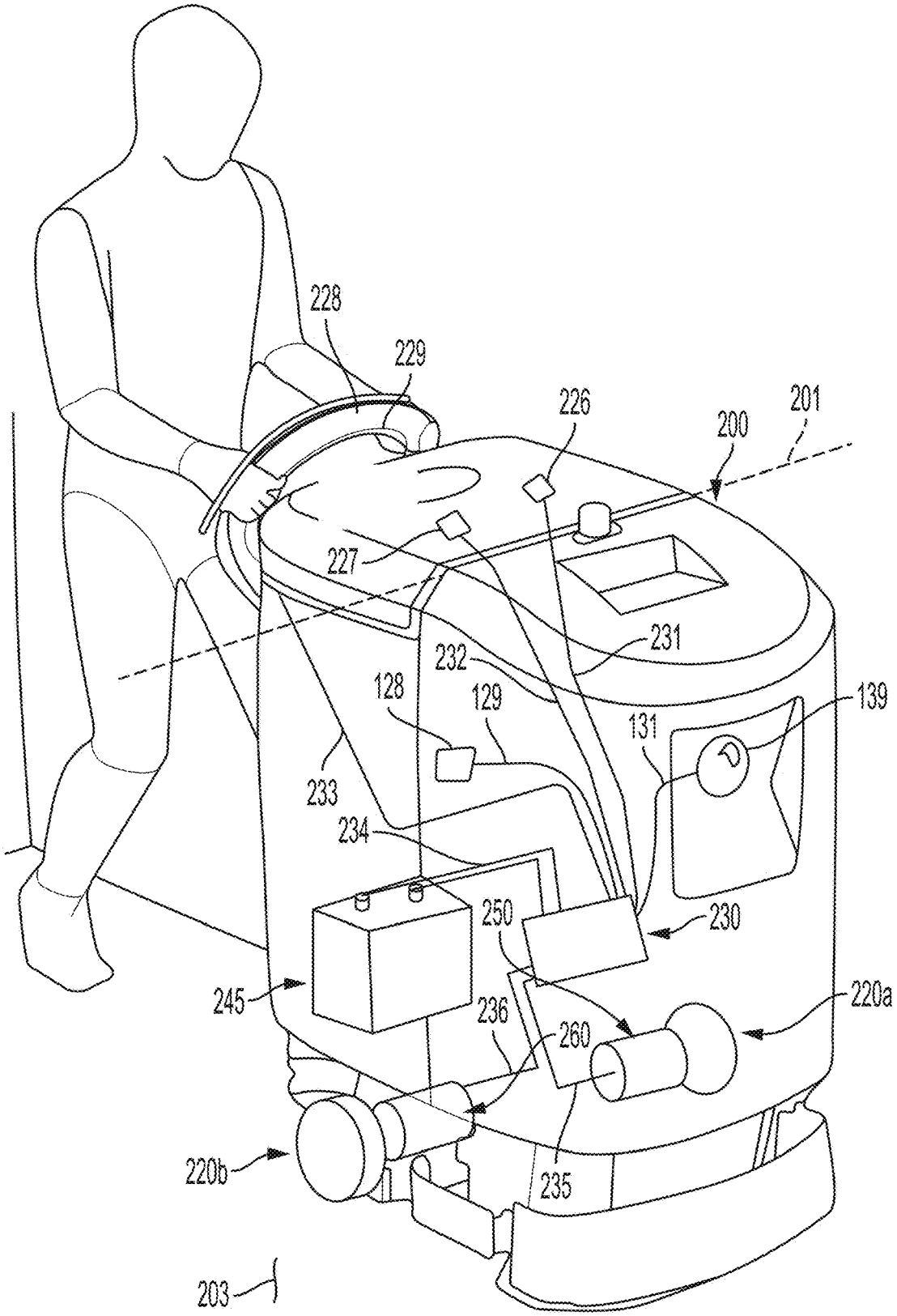
FIG. 2 is a partially transparent, schematic perspective view of the surface maintenance machine of FIG. 1 showing various components of the surface maintenance machine.

FIG. 2 illustrates the surface maintenance machine 200 in a partially transparent, perspective view so that various components of the surface maintenance machine 200 can be seen. As noted previously, the machine 200 can include the grab handle 228, the bail 229, and various user operational controls, including the manual/autonomous mode user input mechanism 226 and the torque assist user input mechanism 227. In some embodiments, one or more of the grab handle 228, the bail 229, or the various user operational controls including the user input mechanisms 226 and 227 are positioned to the rear of a transverse centerline 201 of the machine.

When the machine 200 is operated in a manually driven mode, the grab handle 228 and the bail 229 can be configured to cause the machine 200 to move along a surface at which a surface maintenance task is desired to be performed. To begin moving the machine 200, the user can grasp the grab handle 228 and actuate the bail 229 to cause a motive force to be applied at the machine 200. For example, the bail 229 can be configured to be actuated via a user applying a pull force at the bail 229 (e.g., to move the bail 229 toward the grab handle 228). A first actuation (e.g., a user applied pull force at the bail 229) of the bail 229 can activate application of the motive force at the machine 200, and a second actuation (e.g., a user releasing, and thus terminating the pull force at, the bail 229) of the bail 229 can terminate application of the motive force at the machine 200. The grab handle 228 can provide a surface at which a user of the machine 200 can grasp the machine 200 during manual operation and apply desired user-originated forces. For instance, in the manually driven mode, the grab handle 228 can be grasped and used by a user to apply user forces at the machine 200 in different directions to cause the machine 200 to move forward, move rearward, turn in various directions or orientations on the underlying surface, and change orientation of the machine 200.

As illustrated, the machine 200 can include a controller 230. The controller 230 can be, for example, a programmable processor that is configured to execute non-transitory computer-readable instructions stored in a non-transitory memory component (e.g., at the controller 230). As one particular example, the controller 230 can include a controller from Roboteg™ serial number SBLM2360T. Execution of the non-transitory computer-readable instructions at the controller 230 can cause the machine 200 to perform one or more various features disclosed herein.

The bail 229 can be coupled to the controller 230, such as via a line 233. As noted, the bail 229 be configured to be actuated to cause the machine 200 to move along a surface at which a surface maintenance task is desired to be performed. When actuated, the bail 229 can be configured to send a corresponding bail input signal to the controller 230 via the line 233. The controller 230 can receive the bail input signal and, in response, output a control signal to one or more components at the machine 200 (e.g., one or both independently controlled motors) to cause such one or more components to take a corresponding action.

In some examples, the bail 229 can have more than two positions (e.g., pulling force on bail and releasing force on bail) with each position corresponding to a different operation of the machine 200. For example, a first position of the bail can cause one or more controllers (e.g., 230) to operate in a torque assist mode which causes the machine to move forward with torque assist. Additionally, a second position of the bail can cause one or more controllers (e.g., 230) to disable a torque assist mode and cause the machine to stop providing power to motors. Further, a third position of the bail can cause one or more controllers (e.g., 230) to operate in a reverse torque assist mode which causes the machine to move rearward with torque assist.

The manual/autonomous mode user input mechanism 226 can be coupled to the controller 230, such as via a line 231. The manual/autonomous mode user input mechanism 226 can receive one or more inputs thereat from the user of the machine 200 and, as a result, send one or more corresponding input signals to the controller 230 via the line 231. For example, the manual/autonomous mode user input mechanism 226 can be configured, when actuated, to send a mode control signal to the controller 230 corresponding to one of a manual mode command and an autonomous mode command. For instance, a first actuation of the manual/autonomous mode user input mechanism 226 can cause the manual/autonomous mode user input mechanism 226 to send a manual mode control signal to the controller 230, and a second, different actuation of the manual/autonomous mode user input mechanism 226 can cause the manual/autonomous mode user input mechanism 226 to send an autonomous mode control signal to the controller 230. As illustrative examples the first actuation of the manual/autonomous mode user input mechanism 226 can be a user providing a manual mode selection at the manual/autonomous mode user input mechanism 226 (e.g., via a manual mode button at the manual/autonomous mode user input mechanism 226) and the second actuation of the manual/autonomous mode user input mechanism 226 can be a user providing an autonomous mode selection at the manual/autonomous mode user input mechanism 226 (e.g., via an autonomous mode button at the manual/autonomous mode user input mechanism 226).

When the controller 230 receives the manual mode command from the manual/autonomous mode user input mechanism 226, the controller 230 can, in response, execute non-transitory computer-readable instructions to cause the machine 200 to be configured for operation in a manually driven mode. Likewise, when the controller 230 receives the autonomous mode command from the manual/autonomous mode user input mechanism 226, the controller 230 can, in response, execute non-transitory computer-readable instructions to cause the machine 200 to be configured for operation in an autonomously driven mode.

When the surface maintenance machine 200 is configured for operation in the manually driven mode (e.g., in response to the controller 230 receiving the mode control signal corresponding to the manual mode command), the torque assist user input mechanism 227 can be enabled so as to allow the torque assist user input mechanism 227 to send a torque assist control signal to the controller 230. When so enabled, the torque assist user input mechanism 227 can be configured, when actuated, to send the torque assist control signal to the controller 230, and the torque assist control signal can correspond to a torque assist on command or a torque assist off command. When the torque assist on command is executed by the controller 230, the controller 230 can cause the surface maintenance machine 200 to execute a torque assisted power operation, as will be described further herein. When the torque assist off command is executed by the controller 230, the controller 230 can cause the machine 200 to terminate execution of the torque assisted power operation. Furthermore, in some embodiments, when the machine 200 is configured for operation in the autonomously driven mode (e.g., in response to the controller 230 receiving the mode control signal corresponding to the autonomous mode command), the torque assist user input mechanism 227 can be disabled so as to prevent the torque assist user input mechanism 227 from sending a torque assist control signal to the controller 230. Of course, in some embodiments when the surface maintenance machine 200 is configured for operation in the manually driven mode, the torque assist user input mechanism 227 can be disabled and the controller 230 can operate in velocity control mode in which the wheels are controlled to a particular velocity setting, forward or rearward, in response to the user moving, for instance, a bail switch. In some embodiments, when a torque assist mode is disabled, one or more controllers (e.g., 230) can either cause the machine to stop providing power to its motor(s) or cause the machine to enter a velocity control mode in which the velocity is set to zero.

In some embodiments, a vehicle controller can be interposed between the bail 229 and the controller 230. In similarity with the controller 230, the vehicle controller can be, for example, a programmable processor that is configured to execute non-transitory computer-readable instructions stored in a non-transitory memory component (e.g., at the vehicle controller). In operation, the vehicle controller can send, receive, and/or relay signals with the controller. For instance, the vehicle controller can relay signals from the bail 229 and/or other controls to the controller 230. Additionally or alternatively, the vehicle controller can provide one or more settings to the controller such as, for example, a torque output setting.

The surface maintenance machine 200 can also include a power source 245, a first wheel motor 250, a first driven wheel 220*a*, a second wheel motor 260, and a second driven wheel 220*b*. The power source 245 can be, for instance, one or more rechargeable batteries, and the power source 245 can be coupled to the controller 230, such as via one or more lines 234. The power source 245 can be configured to provide operational power to various (e.g., all) powered components at the machine 200. The first wheel motor 250 can be coupled to both the controller 230, such as via a line 235, and the first driven wheel 220*a* (e.g., via a first mechanical rotor coupling). The first wheel motor 250 can be configured to receive a first driven wheel motive command from the controller 230 and, in response, generate a corresponding motive force and apply this corresponding motive force to the first driven wheel 220*a*. The second wheel motor 260 can be coupled to both the controller 230, such as via a line 236, and the second driven wheel 220*b* (e.g., via a second mechanical rotor coupling). The second wheel motor 260 can be configured to receive a second driven wheel motive command from the controller 230 and, in response, generate a corresponding motive force and apply this corresponding motive force to the second driven wheel 220*b*. The first wheel motor 250 and the second wheel motor 260 can be separate motors, and, in one specific embodiment, each of the first wheel motor 250 and the second wheel motor 260 can be a separate permanent magnet alternating current ("AC") motor. The first wheel motor 250 can be operated independently of the second wheel motor 260. As such, the controller 230 can send a motive command to only one of the motors 250, 260 and/or send different motive commands to the motors 250, 260 so as to cause the motors 250, 260 to independently apply specified, and in some instances different, motive forces to the driven wheels 220*a*, 220*b*.

In addition to the first driven wheel 220*a* and the second driven wheel 220*b*, the machine 200 can include one or more additional wheels. For example, in some embodiments, the machine 200 can also include one or more non-driven (e.g., caster, idler) wheels. In one such example, the machine 200 can include the first and second driven wheels 220*a*, 220*b* rear of a transverse centerline 201 of the machine 200 and include one or more non-driven (e.g., caster, idler) wheels forward of the transverse centerline 201 of the machine 200. Such an exemplary configuration where the first and second driven wheels 220*a*, 220*b* are rear of the transverse centerline 201 and one or more non-driven wheel(s) are forward of the transverse centerline 201 can be useful in reducing rear-swing of the machine 200 and, thus, can configure the machine 200 to operate in relatively confined spaces. This can be particularly true in reducing rear-swing where the first and second driven wheels 220*a*, 220*b* are rear of, but proximate to, the transverse centerline 201. For instance, the first and second driven wheels 220*a*, 220*b* can rear of the transverse centerline 201 and within three inches, six inches, nine inches, twelve inches, fifteen inches, eighteen inches, twenty one inches, twenty four inches, twenty seven inches, or thirty inches of the transverse centerline 201. In another example, the machine 200 can include one or more non-driven wheel(s) rear of the transverse centerline 201 and the first and second driven wheels 220*a*, 220*b* forward of the transverse centerline 201. The transverse centerline 201 can, for instance, be defined as a plane extending perpendicular to a surface 203, on which the machine 200 operates, and intersecting a longitudinal center of the machine 200. Forward of the transverse centerline 201 can be in a forward direction of travel of the machine 200, and rearward of the transverse centerline 201 can be in a reverse direction of travel of the machine 200.

As noted, the machine 200 can be switched between manually driven and autonomously driven modes (e.g., via actuation of the manual/autonomous mode user input mechanism 226).

To facilitate operation of the machine 200 in the autonomously driven mode, the machine 200 can include onboard one or more vision sensors 139. The vision sensor 139 can be coupled to the controller 130, such as via a line 131. The vision sensor 139 can be configured to scan and detect features in the ambient environment of the machine 200. In some embodiments, the vision sensor 139 can include one or more of visible light and/or thermal (infrared) vision cameras, LIDAR sensors, laser beacons, ultrasound sensors, and the like to detect features of the environment (such as physical boundaries and the like). In some embodiments, the vision sensors 139 can be provided at various, spaced apart locations on the machine 200 (e.g., front, lateral sides, rear, and the like) so as to obtain data corresponding to areas at different locations around the machine 200 over a relatively wide field of view. In some particular embodiments, the field of view of the vision sensors 139 can correspond to an angle of between about 200 degrees and about 300 degrees, and a radius of between about 50 feet and 150 feet. In one yet more particular embodiment, the field of view of the vision sensors 139 can be approximately 240 degrees and a radius of approximately 90 feet.

In certain embodiments, also to help facilitate operation of the surface maintenance machine 200 in the autonomously driven mode, the machine 200 can also include a location sensor 128. The location sensor 128 can be coupled to the controller 130, such as via a line 129, and the location sensor 128 can include a wireless transceiver configured to output a wireless signal and receive a wireless signal. The location sensor 128 can permit ascertaining localization the machine 200, such as before, during, or after mapping of a location at which the machine 200 is to operate autonomously. In some embodiments, the location sensor 128 can include a Global Positioning System ("GPS") sensor. Alternatively, or in addition, the location sensor 128 can include an inertial measurement unit (e.g., compass, accelerometer, gyroscope, magnetometer and the like). In addition, additional components such as wireless communication beacons (e.g., WiFi or Bluetooth) can be provided at the location sensor 128 to improve accuracy of localization.

To further assist operation of the surface maintenance machine 200 in the autonomously driven mode, the machine 200 can include a mapping system. The mapping system can, for instance, be executed at the controller 130, such as via a mapping processor and mapping computer-executable instructions at the controller 130. The mapping processor can have one or more integrated circuits that can be in electrical communication with an on-board or a remote non-transitory memory component. The memory component can store mapping instructions in the form of a mapping software program that can be executed by the mapping processor to generate a map for use by the machine 200 to navigate a location in the autonomously drive mode. The mapping processor can be coupled (e.g., via the controller 130) to the one or more vision sensors 139 and/or location sensor 128. For instance, the mapping processor can be coupled (e.g., via electrical circuits provided on the machine 100) to the vision sensors 139 and/or location sensor 128 such that data collected by vision sensors 139 (e.g., electrical signals representative thereof) and/or the location sensor 128 can be transmitted to the mapping processor via the electrical circuits. The mapping processor can also send control signals to initiate data collection at the vision sensors 139 and/or the location sensor 128.

In some examples, the mapping system can also include a visualization processor. The visualization processor can be provided as a part of the controller 130 (e.g., GPGPU component at the controller 130) at the surface maintenance machine 200. The visualization processor can have one or more integrated circuits that can be in electrical communication with the mapping processor. Additionally, the visualization processor can be in electrical communication with the on-board and/or remote memory component. The memory can store computer-readable visualization instructions in the form of a visualization software program that can be executed by the visualization processor to generate a map of the location at which the machine 200 is to be autonomously operated. The controller 130 can then execute the generated map to provide control signals to the motors 250, 260.

When in the autonomously driven mode, the surface maintenance machine 200 can be configured to operate in a speed control mode (sometimes referred to as velocity control mode) for applying motive force, via the independently controlled motors 250, 260, to the driven wheels 220*a*, 220*b*. For example, the controller 230 can execute a speed control mode program stored in a non-transitory memory component at the machine 200 in the form of computer-readable instructions executable by the controller 230 to cause the controller 130 to control movement of the machine 200 via the speed control mode.

When operated in the speed control mode, the controller 130 is provided with a predetermined set speed command, and the controller 130 is configured to control the motors 250, 260 according to this predetermined set speed command (e.g., a predetermined set speed metric). In some examples, the predetermined set speed command can be provided by the user at the machine 200, and in other examples the predetermined set speed command can be provided by the machine 200 based on one or more preprogrammed instructions (e.g., a preprogramed default autonomous mode speed parameter). The controller 230 is configured to use this predetermined set speed command to output one or more first speed command signals, corresponding to the predetermined set speed command, to the first wheel motor 250 and one or more second speed command signals, corresponding to the predetermined set speed command, to the second wheel motor 260. The first wheel motor 250 is configured to control its motor speed (and, thus, first driven wheel 220*a* speed) according to the first speed command signal from the controller 230. The second wheel motor 260 is configured to control its motor speed (and, thus, second driven wheel 220*b* speed) according to the second speed command signal from the controller 130. As such, when the machine 200 is in in the autonomously driven mode, the motors 250, 260 can be controlled independently by the controller 130 to operate at a motor speed corresponding to the predetermined set speed command.

For example, the speed control mode can be configured to control the speed of each motor 250, 260 via the amount of voltage provided to the respective motors 250, 260. As such, to maintain the predetermined set speed command for each motor 250, 260 as a load at each of the motors 250, 260 varies during operation in the autonomously driven mode, the speed of the respective motors 250, 260 can be accelerated or decelerated as applicable to the particular instantaneous applied load at the respective motors 250, 260. As one such example, to maintain the predetermined set speed command for the first wheel motor 250 when the first wheel motor 250 experiences a load acting to decelerate the speed of the first wheel motor 250 (e.g., machine 200 traversing an inclined surface), the controller 130 can output the first speed command signal, corresponding to the predetermined set speed command, to cause the speed of the first wheel motor 250 to increase and, thereby, accelerate the speed of the first wheel motor 250 until the speed of the first wheel motor 250 is increased to the predetermined set speed command. As another similar example, to maintain the predetermined set speed command for the first wheel motor 250 when the first wheel motor 250 experiences a load acting to accelerate the speed of the first wheel motor 250 (e.g., machine 200 traversing an declined surface), the controller 130 can output the first speed command signal, corresponding to the predetermined set speed command, to cause the speed of first wheel motor 250 to decrease and, thereby, decelerate the speed of the first wheel motor 250 until the speed of the first wheel motor 250 is reduced to the predetermined set speed command. The second wheel motor 260 can be controlled in the same, but independent, manner in the speed control mode via the second speed command signal from the controller 130. Because the first wheel motor 250 and the second wheel motor 260 can be controlled independently by the controller 130, the rate of rotation of the first driven wheel 220*a* can be controlled, in certain instances (e.g., to turn the machine 200 in the autonomously driven mode) to be a different than the rate of rotation of the second driven wheel 220*b*.

As noted, the speed control mode can be configured to control the speed of each motor 250, 260 via a controlled amount of voltage provided to the respective, independently controlled motors 250, 260. As one such example, the speed control mode can be executed at the machine 200, in the autonomously driven mode, using a pulse width modulated signal with a specific duty cycle that is increased or decreased to increase or decrease the rate of rotation of the respective driven wheel 220*a*, 220*b*. In addition, each of the first wheel motor 250 and the second wheel motor 260 can provide feedback to the controller 130 indicating the current rate of rotation of the respective drive wheel 220*a*, 220*b*. This feedback from each motor 250, 260 can be used by the controller 130 to adjust the respective voltage provided to each motor 250, 260 (e.g., adjusting the voltage provided to one motor 250 if one wheel 220*a* is rotating faster or slower than expected that corresponding to the predetermined set speed command for that motor 250).

When in the manually drive mode, the torque assist user input mechanism 227 can be enabled. When enabled, the torque assist user input mechanism 227 can be configured, when actuated, to send a first torque assist control signal to the controller 130 corresponding to a torque assist on command. When the torque assist control signal, corresponding to the torque assist on command, is executed by the controller 130, the controller 130 can cause the machine 200 to execute a torque assisted power operation. On the other hand, the torque assist user input mechanism 227 can also be configured to be actuated (e.g., a second actuation different than the actuation causing the torque assist on command) to cause a second torque assist control signal to be sent from the controller 130 to the motors 250, 260 corresponding to a torque assist off command. When the torque assist control signal, corresponding to the torque assist off command, is executed by the controller 130, the controller 130 can cause the machine 200 to terminate a torque assisted power operation.

When enabled and upon actuation of the torque assist user input mechanism 227, the surface maintenance machine 200 can be configured to operate in a torque control mode for applying motive force to the driven wheels 220*a*, 220*b*. For example, the controller 130 can execute a torque control mode program stored in a non-transitory memory component at the machine 200 in the form of computer-readable instructions executable by the controller 130 to cause the controller 130 to control movement of the machine 200 via the torque control mode. The torque control mode, implemented when the machine 200 is in the manually drive mode, can be different than the speed control mode, implemented when the machine 200 is in the autonomously drive mode.

As noted, when in the manually driven mode, the surface maintenance machine 200 can be configured to operate in a torque control mode for applying motive force, via the independently controlled motors 250, 260, to the driven wheels 220*a*, 220*b*. For example, the controller 230 can execute the torque control mode program to cause the controller 230 to control movement of the machine 200 via the torque control mode. When operated in the torque control mode, the controller 230 is provided with a predetermined set torque command, and the controller 230 is configured to control the motors 250, 260 according to this predetermined set torque command (a predetermined set torque metric). In some examples, the predetermined set torque command can be provided by the user at the machine 200 (e.g., user selection of one of at least a preprogramed manual mode first torque parameter and a preprogramed manual mode second torque parameter different than the preprogramed manual mode first torque parameter), and in other examples the predetermined set torque command can be provided by the machine 200 based on one or more preprogrammed instructions (e.g., a preprogramed default manual mode first torque parameter). The controller 230 is configured to use this predetermined set torque command to output one or more first torque command signals, corresponding to the predetermined set torque command, to the first wheel motor 250 and one or more second torque command signals, corresponding to the predetermined set torque command, to the second wheel motor 260. The first wheel motor 250 is configured to control its motor torque according to the first torque command signal from the controller 130. And, the second wheel motor 260 is configured to control its motor torque according to the second torque command signal from the controller 230. As such, when the machine 200 is in in the manually driven mode, the motors 250, 260 can be controlled independently by the controller 230 to operate at motor torque corresponding to the predetermined set torque command.

For example, the torque control mode can be configured to control the torque output of each motor 250, 260 via the amount of power (e.g., current and/or voltage) delivered to the respective motors 250, 260. As such, to maintain the predetermined set torque command for each motor 250, 260 as a load at each of the motors 250, 260 varies during operation in the manually driven mode, the torque of the respective motors 250, 260 can be increased or decreased as applicable to the particular instantaneous applied load at the respective motors 250, 260. As one such example, to maintain the predetermined torque command for the first wheel motor 250 when the first wheel motor 250 experiences an increase in load acting on the first wheel motor 250 (e.g., machine 200 traversing an inclined surface; a user pulling, or otherwise applying a force that restricts movement of, the machine 200), the controller 130 can output the first torque command signal, corresponding to the predetermined set torque command, to cause the torque of the first wheel motor 250 to decrease and, thereby, decrease the torque applied at the first driven wheel 220*a*, via the first wheel motor 250, until the torque of the first wheel motor 250 is decreased to the predetermined set torque command. In another similar example, to maintain the predetermined set torque command for the first wheel motor 250 when the first wheel motor 250 experiences a decreased load acting on the first wheel motor 250 (e.g., machine 200 traversing a declined surface; a user pushing, or otherwise applying a force that increases movement of the machine 200), the controller 230 can output the first torque command signal, corresponding to the predetermined set torque command, to cause the torque of the first wheel motor 250 to increase and, thereby, increase the torque applied at the first driven wheel 220*a*, via the first wheel motor 250, until the torque of the first wheel motor 250 is increased to the predetermined set torque command. The second wheel motor 260 can be controlled in the same, but independent, manner in the torque control mode via the second torque command signal from the controller 130. Because the first wheel motor 250 and the second wheel motor 260 can be controlled independently by the controller 230, the rate of rotation of the first driven wheel 220*a* can be controlled, in certain instances (e.g., to help turn the machine 200 along with user applied turn force in the manually driven mode) to be a different than the rate of rotation of the second driven wheel 220*b*.

Figure 3:
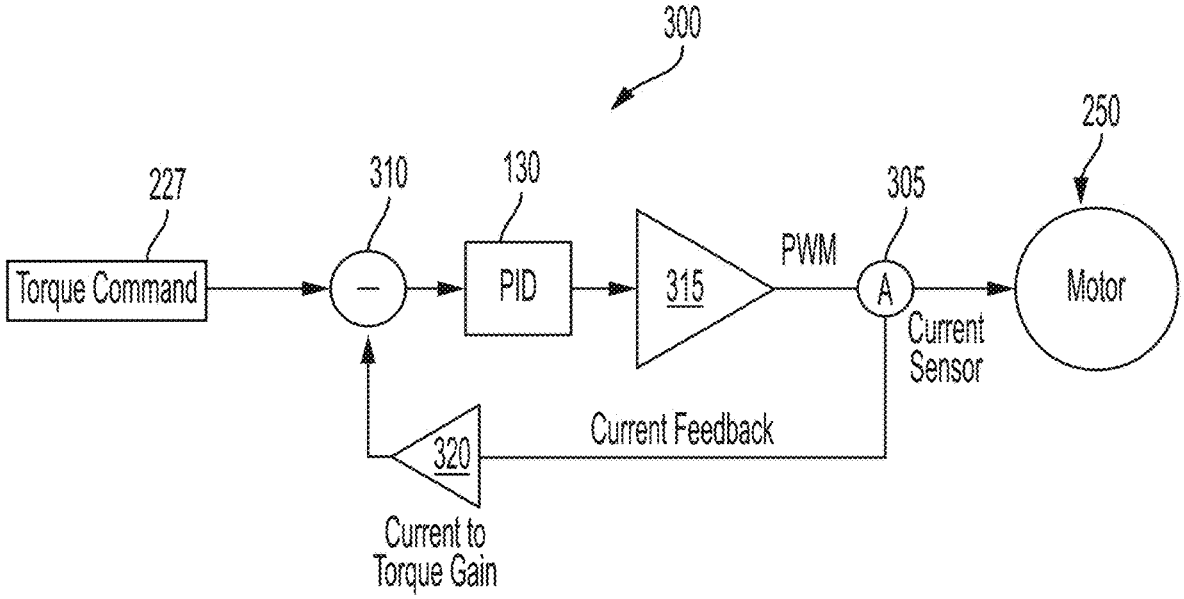
FIG. 3 is a block diagram of an exemplary embodiment of circuitry for executing a closed-loop torque control mode.

FIG. 3 illustrates a schematic block diagram of an exemplary embodiment of circuitry 300 for executing a closed-loop torque control mode. The circuitry can include a comparator stage 310, proportional-integral-derivative controller (PID) controller 130, a pulse width modulation (PWM) stage 315, a current sensor 305, and a current to torque gain stage 320.

In a general example operation, a torque command 227, which can be a predetermined set torque command received from an operator via a bail, is received by the circuitry and goes through the comparator stage 310 to the PID controller 130 and the PWM stage 315. The PID controller, in conjunction with the PWM stage, can interpret and adjust the torque command into a signal having a voltage and current level which is applied to the motor 250. In some examples, the PID controller 130 and the PWM stage can modulate a voltage applied to the motor 250 to effectuate a change in the corresponding current applied to the motor 250. As discussed above, adjusting the current applied to the motor 250 can adjust the torque applied at a corresponding driven wheel. The current applied to the motor 250 can then be measured by the current sensor 305 and feed back to the comparator 310 after passing through the current to torque gain stage 320 to be converted to a torque level. In some examples, though, the current sensor and the current to torque gain stage are replaced by a torque sensor. The torque sensor can be coupled to the motor and can directly measure a torque (e.g., via an internal strain gauge). Further, the torque sensor can output a torque level to the comparator stage 310.

The comparator 310 can then compare the torque level from the current feedback, which represents the torque the motor is actively applying to a driven wheel, with the torque command 227, which represents the desired torque. If the torque level from the current feedback is less than the torque command level, the comparator 310 outputs a signal which the PID controller 130 and the PWM stage 315 use to increase the current applied to the motor. Alternatively, if the torque level from the current feedback is greater than the torque command level, the comparator 310 outputs a signal which the PID controller 130 and the PWM stage 315 use to decrease the current applied to the motor. However, if the torque level from the current feedback is equal to the torque command level, the comparator outputs a signal which the PID controller 130 and the PWM stage 315 use to maintain the same current applied to the motor. Thus, the circuitry 300 can enable effective control of torque applied by the motor to a driven wheel, ensuring the torque command corresponds closely with the actual torque applied by the motor to a driven wheel.

As discussed above, in operation, the motor 250 can experience an increase or decrease in external loads. For example, the motor 250 can experience an increased load acting on it when the machine traverses an inclined surface; a user pulling, or otherwise applying a force that restricts movement of the machine. In such an example, the increased load on the motor 250 can increase the current of the motor and increase the torque the motor 250 applies to a driven wheel. In response to this increased current, the circuitry 300 that executes the closed-loop torque control can attempt to decrease the torque applied by the motor 250 to the driven wheel by decreasing the current applied to the motor 250. In such an example, the current sensor 305 can measure the increased current of the motor 250 and feedback the current to the comparator 310 through the current to torque gain stage 320. After the current is converted to a torque via the current to torque gain stage 320, the comparator 310 can determine that the level of torque from the torque command is less than the level of feedback torque. In response, the PID controller 130 and the PWM stage 315 can use the resulting signal received from the comparator to decrease the voltage applied to the motor, thereby decreasing the current and the torque that the motor applies to the driven wheel. In such an operation, if the increased load is due to a user pulling or otherwise applying a force that restricts movement of the machine, the user is assisted in that the movement of the machine is correspondingly decreased.

In an alternative example operation, the motor 250 can experience a decreased load acting on it when the machine traverses a declined surface; a user pushing, or otherwise applying a force that increases movement of the machine. In such an example, the decreased load on the motor 250 can decrease the current of the motor and decrease the torque the motor 250 applies to a driven wheel. In response to this decreased current, the circuitry 300 that executes the closed-loop torque control can attempt to increase the torque applied by the motor 250 to the driven wheel by increasing the current applied to the motor 250. In such an example, the current sensor 305 can measure the decreased current of the motor 250 and feed back the current to the comparator 310 through the current to torque gain stage 320. After the current is converted to a torque via the current to torque gain stage 320, the comparator 310 can determine that the level of torque from the torque command is greater than the level of feedback torque. In response, the PID controller 130 and the PWM stage 315 can use the resulting signal received from the comparator to increase the voltage applied to the motor, thereby increasing the current and the torque that the motor applies to the driven wheel. In such an operation, if the decreased load is due to a user pushing or otherwise applying a force that increases movement of the machine, the user is assisted in that the movement of the machine is correspondingly increased.

While the circuitry 300 is shown and described as comprising discrete components and operating using analog signals (e.g., a current signal), a person of ordinary skill will appreciate the circuitry is not so limited. For instance, in some embodiments, the circuitry 300 can comprise integrated circuits (ICs), which can be any combination of discrete components, and the circuitry 300 can use digital signals to communicate. In some embodiments, the circuitry 300 can comprise a combination of discrete components and non-discrete components (e.g., ICs) and can use both digital signals and analog signals to communicate. For instance, the current sensor 305 can communicate current in the form of a digital signal while a signal applied to the motor 250 is an analog signal.

As discussed above and with reference to FIG. 2 and FIG. 3, the surface maintenance machine 200 can be configured to operate in a torque control mode which is used to control the torque output of a first motor 250 and a second motor 260 via the amount of current provided to the respective motors 250, 260. In such embodiments, the controller 230 controls the first motor 250 and the second motor 260 via the torque control mode and can provide a selected torque output setting to each of the first motor 250 and the second motor 260 (e.g., via user input). Further, the first motor 250 and the second motor 260 can be controlled by two separate control loops that apply the torque control mode to them. For example, the example control loop/logic of FIG. 3 can be duplicated to control the first motor 250 and the second motor 260.

Additionally, as the load at each of the motors 250, 260 varies during operation in the torque control mode, the torque of the respective motors 250, 260 can be increased or decreased as applicable to the particular instantaneous applied load at the respective motors 250, 260. In an example application of the torque control mode, a user can provide an input to the controller 230 (e.g., via a grab handle 228) to turn the surface maintenance machine 200 leftward when the machine is traversing in a forward direction. In such an example, the user can exert a force on the machine via the grab handle to restrict movement of the leftward side of the machine. This restriction of movement of the leftward side of the machine can cause an increase in the load of the first motor 250 (e.g., a leftward motor) which can increase the current of the first motor and increase a torque that the first motor applies 250 to the first driven wheel 220*a*. The controller 230 can sense this increase in torque via the corresponding current sensor (e.g., 305) and can decrease the power delivered to the first motor 250 to decrease the torque. In some examples, decreasing the power delivered to the first motor comprises decreasing a current applied to the first motor. Additionally or alternatively, in some examples, decreasing the power delivered to the first motor comprises decreasing a voltage applied to the first motor.

Continuing with the example, the user can exert a force on the machine (e.g., via the grab handle) to increase movement of the rightward side of the machine. This increase of movement of the rightward side of the machine can cause a decrease in the load of the second motor 260 (e.g., a rightward motor) which can decrease the current of the second motor and decrease a torque that the second motor 260 applies to the second driven wheel 220*b*. The controller 230 can sense this decrease in torque via the corresponding current sensor (e.g., 305) and can increase the power delivered to the second motor 260 to increase the torque. In some examples, increasing the power delivered to the second motor comprises increasing a current applied to the second motor. Additionally or alternatively, in some examples, increasing the power delivered to the second motor comprises increasing a voltage applied to the second motor. Thus, the controller 230 can aid a user in turning the surface maintenance machine 200 leftward by decreasing the torque of the first motor 250 and increasing the torque of the second motor 260. In a similar manner, the controller can aid a user in turning the surface maintenance machine 200 rightward by increasing the torque of the first motor 250 and decreasing the torque of the second motor 260.

Figure 4:
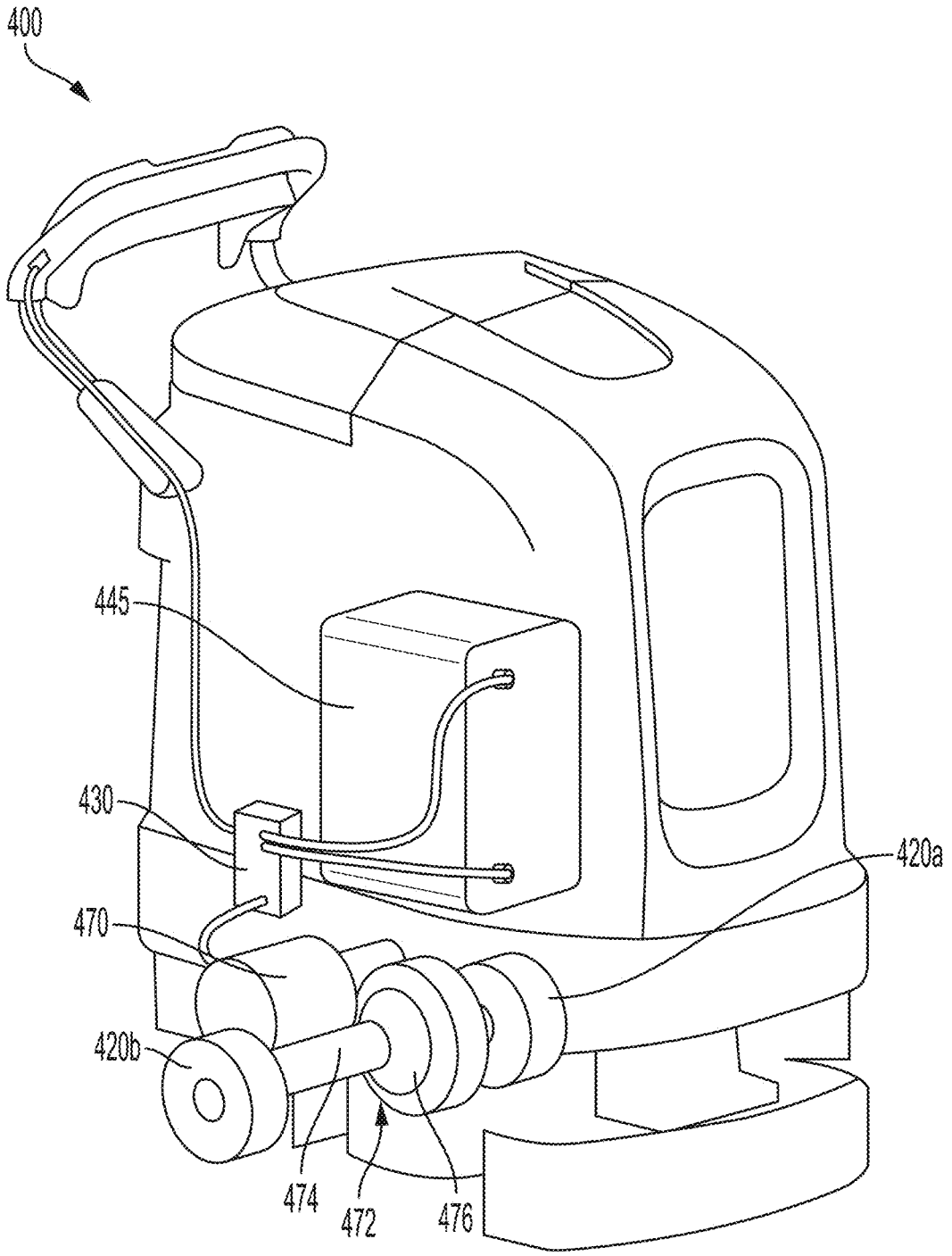
FIG. 4 is a partially transparent, schematic perspective view of an example surface maintenance machine having a single motor and a transaxle.

Moving to FIG. 4, FIG. 4 is a partially transparent, schematic perspective view of an example surface maintenance machine 400 having a single motor 470 and a transaxle 472. The surface maintenance machine 400 includes a motor controller 430 and a motor 470 that are powered by a battery 445. The surface maintenance machine 400 further includes a left drive wheel 420*a* and a right drive wheel 420*b* that are connected to the motor 470 via a transaxle 472. The transaxle 472 comprises an axel 474 and a differential 476 that enables the connected left drive wheel 420*a* and right drive wheel 420*b* to turn at different speeds. The transaxle 472 connects to the motor 470 via its differential 476 which enable the machine 400 to operate with a single motor 470. In comparison to the embodiment of FIG. 2, the embodiment of FIG. 4 does not require two motors which can decrease cost and energy use, enabling a longer runtime of the machine. However, the embodiment of FIG. 2 can have increased maneuverability in comparison to the embodiment of FIG. 4 such as being able to make a zero turn.

Figure 5:
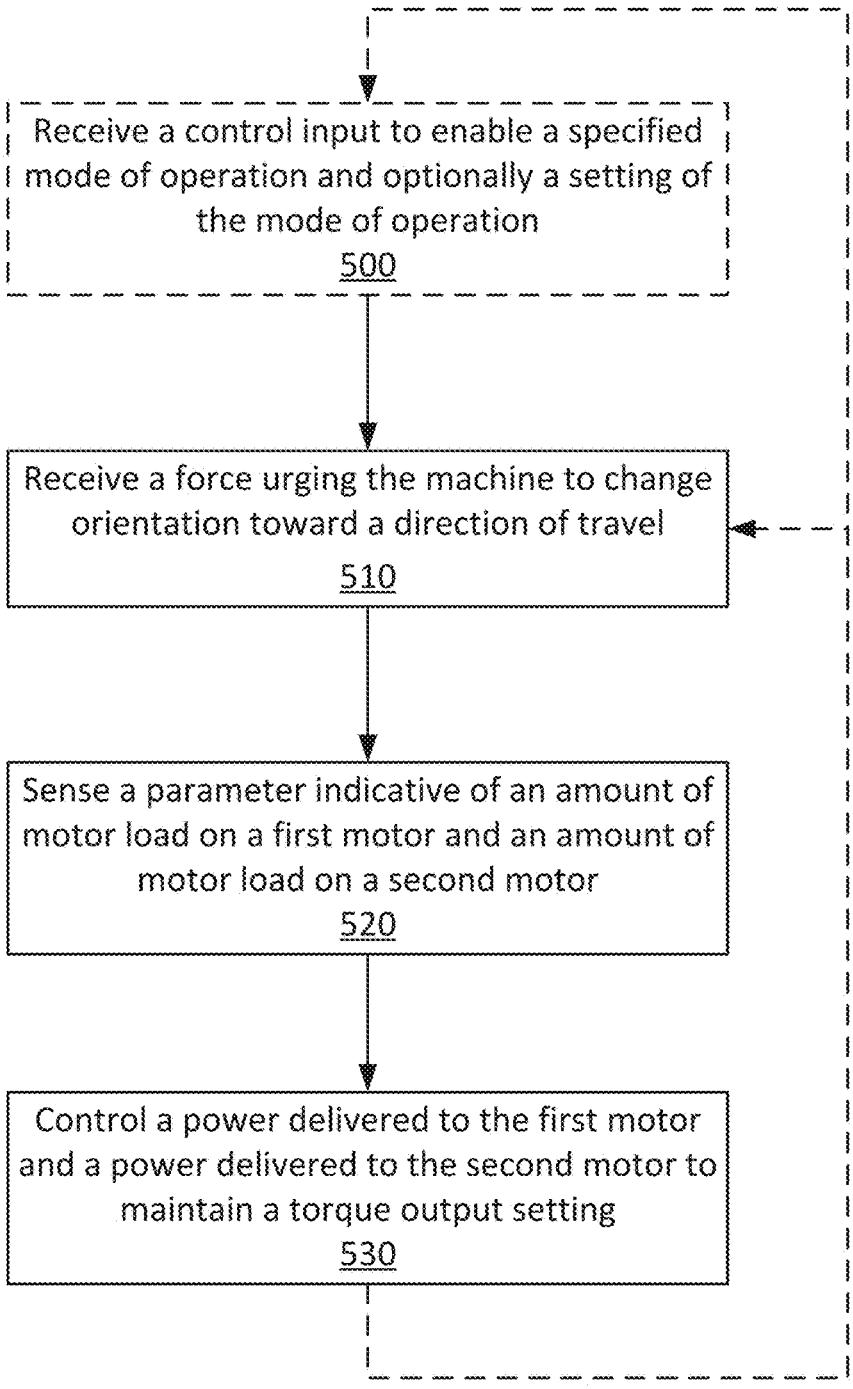
FIG. 5 is a flowchart of an example method of providing a torque assist mode to a surface maintenance machine.

Moving to FIG. 5, FIG. 5 is a flowchart of an example method of providing a torque assist mode to a surface maintenance machine. The method can start with an optional step 500, receiving a control input to enable a specified mode of operation and optionally a setting of the mode of operation. In some embodiments, a controller (e.g., 230) can receive a control input to enable a specified mode of operation. In some such embodiments, the controller can receive a user input from a bail or other user input device to enable the machine to operate in a manual mode, an autonomous mode, a torque assist mode, a speed/velocity control mode, a combination of modes, or other modes of operation. Once the specified mode of operation is enabled, a setting of the specified mode of operation can be enabled. For example, the method can include setting of a specific amount of torque output for one or more motors of the machine.

Next, in step 510, the method includes receiving a force urging the machine to change orientation toward a direction of travel. In some examples, the force urging the machine to change orientation is from a user that imparts a force on a grab handle of the machine. The urging of the machine to change orientation toward a direction of travel can include urging the machine to turn left or right, move forward or backward, or move a combination of directions. In general, the urging of the machine attempts to change the current orientation and/or position of the machine.

Continuing with step 520, the method includes sensing a parameter indicative of an amount of motor load on a first motor and an amount of motor load on a second motor. As discussed elsewhere herein, the parameter indicative of an amount of motor load can include a current or a torque of a motor and can be sensed by a current sensor or a torque sensor respectively.

Further, in step 530, the method includes controlling a power delivered to the first motor and a power delivered to the second motor to maintain a torque output setting. As discussed elsewhere herein with respect to FIG. 2 and FIG. 3, in some examples, a controller (e.g., 230) performs step 530 and can control an amount of power delivered to a motor via controlling an amount of current and/or voltage applied to the motor. Further, in such embodiments, the controller can ensure that a torque output setting is maintained at the first motor and second motor by controlling the power delivered to the first motor and the power delivered to the second motor.

After controlling the power as describe in step 530, the method can either return to step 500 or 510. In general, the method returns to step 510 unless the mode of operation changes. For example, a user can initially engage a torque control mode with a specific torque setting which is received in step 500. Next, the user can impart a force to the machine to change its orientation (e.g., turn left) which is received in step 510. Further, a current sensor, torque sensor, or other sensor can sense an amount of motor load on the first motor and second motor which can then be used by a controller to control a power delivered to the first motor and second motor to maintain a torque output setting. Next, unless a user selects a different mode of operation or disables the current mode of operation, which would result in the method continuing with step 500, the user will again impart a force to the machine to change its orientation and the method repeats with step 510.

In some examples, the method of FIG. 5 is performed by a system such as described with respect to FIG. 2 and FIG. 3. However, a person having ordinary skill in the art will appreciate that the method of FIG. 5 is not limited by the system and structure of FIG. 2 and FIG. 3.

While embodiments of the present disclosure are described as being included, and executed, by a surface maintenance machine, the embodiments are not limited to surface maintenance machines. For instance, in some embodiments, the torque control described elsewhere herein can be used by devices comprising motors including motor vehicles, lawn mowers, carts, scooters, etc.

Various non-limiting exemplary embodiments have been described. It will be appreciated that suitable alternatives are possible without departing from the scope of the examples described herein.

The invention claimed is:

1. A surface maintenance machine comprising:

a maintenance head assembly supported by the machine and extending toward a surface, the maintenance head assembly comprising one or more surface maintenance tools for performing a surface maintenance operation;

first and second wheels for supporting a body of the surface maintenance machine over a surface for movement in a direction of travel, the first and second wheels disposed on opposite sides of a longitudinal centerline of the machine and each having a rotational axis, angles formed between the rotational axes and the longitudinal centerline of the machine being fixed such that the first and second wheels rotate about fixed rotational axes;

an operator grab handle positioned to the rear of a transverse centerline of the machine, the operator grab handle permitting the operator to apply a force on the grab handle urging the machine to change orientation towards a different direction of travel;

a first motor coupled to the first wheel to drive the first wheel;

a second motor coupled to the second wheel to drive the second wheel; and one or more motor controllers operatively connected to the first motor and the second motor, the one or more controllers configured to operate in a torque assist mode, in torque assist mode, the one or more controllers configured to:

sense a parameter indicative of an amount of motor load on the first motor and an amount of motor load on the second motor, control the power delivered to the first motor and the power delivered to the second motor to maintain a torque output setting in light of the motor load on the first motor and on the second motor and in light of the force applied on the grab handle urging the machine to change orientation, whereby the control of the power delivered to the first motor and the second motor to maintain the setting of torque output assists the force applied on the grab handle to change orientation of the machine, wherein a magnitude of power delivered to the first motor and/or to the second motor to maintain the torque output setting corresponds at least to a magnitude of the motor load on the first motor and/or on the second motor.

2. The surface maintenance machine of claim 1, further including a bail operatively connected to the one or more controllers and positioned adjacent to the operator grab handle, the bail being movable to two positions, a first of the two positions causing the one or more controllers operate in the torque assist mode, the operation in torque assist mode causing the machine to move forward on the underlying surface via rotation of the first and second wheels, the second of the two positions being an off mode where the one or more controllers do not provide power to the first motor and to the second motor.

3. The surface maintenance machine of claim 1, wherein the one or more controllers is configured to operate in a manual mode and in an autonomous mode, the manual mode adapted for a user to operate the machine and the autonomous mode adapted for the one or more controllers to operate the machine independent of a user.

4. The surface maintenance machine of claim 3, further comprising a user input for the user to select between the manual mode and the autonomous mode.

5. The surface maintenance machine of claim 3, wherein the one or more controllers operate in velocity control mode when operating in autonomous mode, and in the velocity control mode the one or more controllers controls the power delivered to the first motor and to the second motor to maintain desired rotational speeds of the first motor and of the second motor.

6. The surface maintenance machine of claim 1, further including one or more non-driven swivel caster wheels.

7. The surface maintenance machine of claim 6, wherein the one or more non-driven swivel caster wheels are positioned forward of the transverse centerline of the machine.

8. The surface maintenance machine of claim 1, further including one or more sensors operatively connected to the one or more controllers, the sensors being one or more of LIDAR sensors, laser beacons, ultrasound sensors, location sensors, and vision sensors, and the one or more sensors detecting features of the environment surrounding the machine and providing sensed information for the machine to operate in an autonomous mode.

9. The surface maintenance machine of claim 1, wherein the setting of the torque output of the first motor and the torque output of the second motor is user-selectable.

10. The surface maintenance machine of claim 1, wherein the sensed parameter indicative of the amount of motor load is a sensed electrical current to the first motor and a sensed electrical current to the second motor.

11. The surface maintenance machine of claim 10, wherein the torque assist mode employs a feedback loop where the one or more controllers compare the sensed parameter indicative of the amount of motor load for the first motor to the setting to maintain the torque output for the first motor and adjust the power provided to the first motor to maintain the setting of the torque output of the first motor.

12. A method of providing a torque assist mode to a surface maintenance machine, the surface maintenance machine having a maintenance head assembly supported by the machine and extending toward a surface, the maintenance head assembly comprising one or more surface maintenance tools for performing a surface maintenance operation, the method comprising:

receiving a force on a grab handle of the machine urging the machine to change orientation towards a different direction of travel;

sensing a parameter indicative of an amount of motor load on a first motor and an amount of motor load on a second motor, the first motor coupled to a first wheel to drive the first wheel, the second motor coupled to a second wheel to drive the second wheel, the first and second wheels for supporting a body of the surface maintenance machine over a surface for movement in a direction of travel, the first and second wheels disposed on opposite sides of a longitudinal centerline of the machine and each having a rotational axis, angles formed between the rotational axes and the longitudinal centerline of the machine being fixed such that the first and second wheels rotate about fixed rotational axes; and controlling the power delivered to the first motor and the power delivered to the second motor to maintain a torque output setting in light of the motor load on the first motor and on the second motor and in light of the force applied on the grab handle urging the machine to change orientation, whereby the control of the power delivered to the first motor and the second motor to maintain the setting of torque output assists the force applied on the grab handle to change orientation of the machine, wherein the power delivered to the first motor and/or to the second motor to maintain the torque output setting is controlled such that a magnitude of the delivered power corresponds at least to a magnitude of the load on the first motor and/or on the second motor.

13. The method of providing the torque assist mode of claim 12, further comprising receiving a selection of two positions of a bail, a first of the two causing one or more controllers to operate in the torque assist mode, the operation in the torque assist mode causing the machine to move forward on the underlying surface via rotation of the first and second wheels, the second of the two positions disabling the torque assist mode.

14. The method of providing the torque assist mode of claim 12, further comprising receiving a selection to one of a manual mode and an autonomous mode, the manual mode enabling the torque assist mode and being adapted for a user to operate the machine, the autonomous mode disabling the torque assist mode and adapted for the one or more controllers to operate the machine independent of a user.

15. The method of providing the torque assist mode of claim 12, further comprising receiving a selection of the setting of the torque output of the first motor and the torque output of the second motor.

16. The method of providing the torque assist mode of claim 12, further comprising:

comparing the sensed parameter indicative of the amount of motor load for the first motor to the setting to maintain the torque output for the first motor, and adjusting the power provided to the first motor to maintain the setting of the torque output of the first motor.

* * * * *